United States Patent [19]

Austin et al.

[11] Patent Number: 4,974,675

[45] Date of Patent: Dec. 4, 1990

[54] METHOD OF FRACTURING HORIZONTAL WELLS

[75] Inventors: Carl E. Austin; Robert E. Rose; A. Wadood El Rabaa, all of Duncan, Okla.

[73] Assignee: Halliburton Company, Duncan, Okla.

[21] Appl. No.: 490,813

[22] Filed: Mar. 8, 1990

[51] Int. Cl.[5] ..... E21B 43/26; E21B 47/02; E21B 49/02

[52] U.S. Cl. ..... 166/250; 166/308

[58] Field of Search ..... 166/308, 280, 250, 254, 166/50, 269, 271; 73/155

[56] References Cited

U.S. PATENT DOCUMENTS

| | | | |
|---|---|---|---|
| 3,062,286 | 11/1962 | Wyllie | 166/308 |
| 3,089,416 | 5/1963 | Gilbert | 166/308 UX |
| 3,106,959 | 10/1963 | Huitt et al. | 166/308 |
| 3,193,012 | 7/1965 | Huitt et al. | 166/308 X |
| 3,878,884 | 4/1975 | Raleigh | 166/308 X |
| 4,220,205 | 9/1980 | Coursen et al. | 166/308 X |
| 4,529,036 | 7/1985 | Daneshy et al. | 166/254 |
| 4,633,948 | 1/1987 | Closmann | 166/50 X |
| 4,669,546 | 6/1987 | Jennings, Jr. et al. | 166/308 |
| 4,687,061 | 8/1987 | Uhri | 166/308 |
| 4,850,431 | 7/1989 | Austin et al. | 166/308 |
| 4,880,059 | 11/1989 | Brandell et al. | 166/332 |

OTHER PUBLICATIONS

SPE 19720 entitled "Experimental Study of Hydraulic Fracture Geomerty, Initiated from Horizontal Wells" . . . Wadood El Rabaa, Oct. 8–11, 1989.

*Primary Examiner*—Stephen J. Novosad
*Attorney, Agent, or Firm*—Robert A. Kent

[57] ABSTRACT

A method of forming fractures from a highly deviated or horizontal well bore penetrating a subterranean formulation. A well bore is drilled horizontally into a formation and the deviation in the direction of the well bore from the direction of the least principal horizontal stress is determined. Perforations or notches then are produced in casing cemented in the well bore. The notching is effected in such a manner that the direction of the perforation or notch is made perpendicularly to the direction of the least principal horizontal stress in the subterranean formation. A fracturing fluid then is introduced into the well bore at a predetermined rate and pressure to fracture the formation at the fracture initiation points created by the notches whereby fracture reorientation is minimized or eliminated.

19 Claims, 2 Drawing Sheets

METHOD OF FRACTURING HORIZONTAL WELLS

BACKGROUND OF THE INVENTION

1. Field Of The Invention

The present invention provides a method whereby fractures may be created from a highly deviated or horizontal well bore penetrating a formation in a direction other than the direction of the least principal horizontal stress utilizing minimum breakdown pressures while obviating choking caused by fracture reorientation.

2. Description Of The Prior Art

In the production of hydrocarbons or other fluids from subterranean rock formations penetrated by well bores, a commonly used technique for stimulating such production is to create and extend fractures in the formations. Most often, the fractures are created by applying hydraulic pressure to the subterranean formations from the well bores penetrating them. That is, a fracturing fluid is pumped through the well bore and into a formation to be fractured at a rate such that the resultant hydraulic pressure exerted on the formation causes one or more fractures to be created therein. The fractures are extended by continued pumping and the fractures are either propped open by a propping agent, e.g., sand, deposited therein or the fracture faces are etched by a reactive fluid such as an acid whereby hydrocarbons contained in the formation readily flow through the fractures into the well bore.

The term "subterranean formation" is used herein to mean an entire subterranean rock formation bounded by formations formed of dissimilar rock materials or a hydrocarbon containing zone disposed within a larger rock formation.

Most fractures formed in formations by applying hydraulic pressure thereto lie in substantially vertical planes and extend outwardly from the well bore in a direction at right angles to the in situ least principal stress in the formation. When fractures are created from a substantially vertical well bore penetrating the formation, only two vertical fracture wings generally are produced which extend from opposite sides of the well bore in a direction at right angles or perpendicularly to the in situ least principal stress in the formation. Such fracture arrangement represents the ultimate fluid communication between the well and the fracture. Normally, at the end of the fracturing treatment, maximum fracture height and width will be along the vertical well bore walls. The high costs associated with drilling operations has resulted in a desire to enhance the production capability of a well through multiple parallel fracturing of a formation. As a result hydrocarbon reservoirs are now being developed through the use of horizontal wells from which a plurality of spaced parallel fractures can be created. Fractures induced in a subterranean formation from a well bore also are substantially vertical and are in a direction perpendicular to the least principal horizontal stress. A fracture induced in a horizontal well, however, does not extend in a plane aligned with the well bore as in a vertical well unless the well is drilled in a direction perpendicular to the least principal horizontal stress in the formation. For other horizontal well directions, the initial fracture geometry is dependent on the well deviation from the least principal horizontal stress. Not far from the well bore, the fracture reorients regardless of its initial direction to become perpendicular to the direction of the least principal horizontal stress. The reorientation of the fracture results in a fracture width at the well bore which generally is less than that achieved by fractures created from well bores drilled in the direction of the least principal horizontal stress in the formation. Further, during the reorientation, the fracture is extended under both shearing and tensile modes which result in rough surfaced fracture faces which increase fluid friction pressures near the well bore thereby increasing the operating pressures required to propagate the fracture.

It would be desirable to provide a method of fracturing subterranean formations penetrated by horizontal well bore in a direction other than the direction of least principal horizontal stress which avoids or minimizes the problems of reorientation of fractures.

SUMMARY OF THE INVENTION

A method of forming fractures from a highly deviated or horizontal well bore penetrating a subterranean formation in a direction other than the direction of least principal horizontal stress is provided. In accordance with the method, a highly deviated or horizontal well bore is drilled into a hydrocarbon-containing subterranean formations. The deviation of the direction in which the well bore is drilled from the direction of the least principal horizontal stress then is determined. Casing may be placed, and preferably cemented, into the well bore before any fracturing treatment. The casing, if present, and formation surrounding the well bore is notched at predetermined locations within the well bore. The notching is effected in a manner such that a perforation or notch is made into the formation in a direction perpendicular to the direction of the least principal horizontal stress in the formation regardless of the direction of the well bore. A fracturing fluid then is introduced into the well bore and hydraulic pressure is applied to the notched portions of the well bore whereby fractures are caused to be initiated from the well bore in a direction perpendicular to the least principal horizontal stress in the subterranean formation. The fractures are created with a minimum application of hydraulic force and form under the tensile mode whereby surface roughness of the fracture face and angularity is minimized thereby reducing fluid friction and other pressures during the fracturing treatment.

DESCRIPTION OF THE PREFERRED EMBODIMENT

Figure 1:
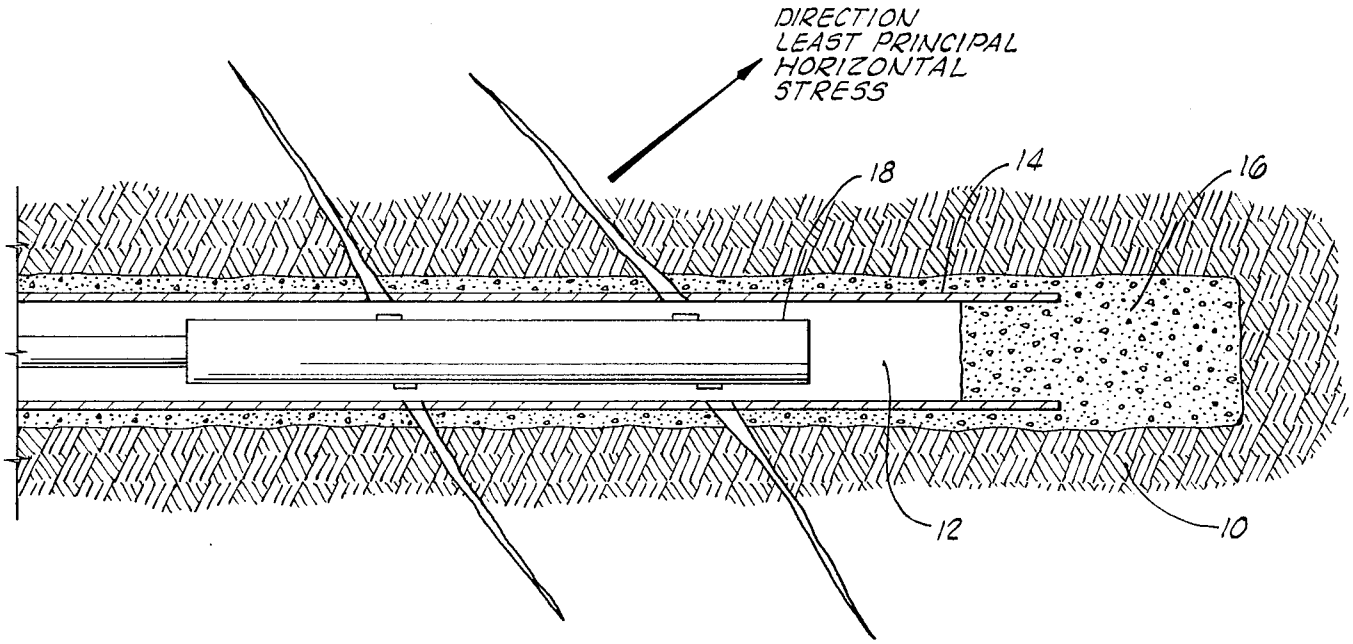
FIG. 1 is a schematic illustration of fractures formed horizontal well bore in accordance with the method of the present invention.

The first step of the method of the present invention for forming fractures in a subterranean formation is the drilling of a well bore into the formation. As is the usual case, the mineral or fluid-containing subterranean formation is bounded by an upper formation and a lower formation formed of dissimilar rock materials. A vertical well is drilled from the surface to a location near the desired formation at which time well known deviated well bore drilling techniques are utilized to extend the well bore into the desired formation. The well bore may penetrate the formation at an angle of from 60 to 120 degrees from the vertical. Such a well bore is referred to as a highly deviated well bore and is often referred to as a horizontal well bore even though it is not actually at 90° from vertical. The well bore also may be described as horizontal if it penetrates a formation at an angle which parallels the direction of the bedding planes in the formation which may contain either synclines or anticlines even though the true angle from vertical is not 90°. Upon completion of the well bore, casing may be introduced into the bore to the total depth, if desired and sealed into the well bore by cementing, if desired, utilizing hydraulic cement, epoxy resins or other bonding materials in accordance with various well known techniques.

The direction of the in situ least principal horizontal stress in the subterranean formation is required because it is at right angles to that direction that fractures induced into the formation will extend. A knowledge of the relative levels of the stresses in the formation and in the bounding formations is advantageous in that it indicates whether fractures formed in the desired formation will be confined to the formation. The direction of the in situ least principal horizontal stress may be determined by any of the well known methods. In one method the formation is subjected to initial fracturing before the well is cased by applying hydraulic pressure to the formation by way of the well bore. Upon forming a fracture, the in situ least principal horizontal stress direction can be determined from the direction of the formed fracture. The fracture direction can be determined, for example, by the use of a direction orientated fracture impression packer, by a direction orientated bore hole televiewer, by strain gauge relaxation measurements on an oriented core sample or by extraction of a location oriented core containing an induced fracture.

The determination of the induced fracture direction in the formation and therefore the in situ least principal horizontal stress is preferably made during the drilling of the well bore. One preferred method is disclosed in U.S. Pat. No. 4,529,036 to Daneshy et al issued July 16, 1985 the entire disclosure of which is incorporated herein by reference and made a part hereof. In accordance with that method, a fracture is created during drilling by exerting hydraulic pressure with drilling fluid by way of the drill pipe on the bottom of the well bore. The fracture formed extends from the lower end portion of the well bore, and a location orientated core containing a portion of the fracture is removed from the well bore. The direction of the fracture in the core determines the direction of the least principal horizontal stress which is perpendicular to the fracture. Other characteristics of the formation and its fracturing also may be determined as described in the patent. The deviation of the direction of the well bore from the direction of the least principal horizontal stress then is determined from directional logging of the well bore or drilling records.

In order to produce fractures extending from the well bore after casing has been set in the well bore, it is necessary to form perforations or notches in the casing to permit communication to the formation. Referring now to the drawings, and particularly, FIG. 1, a top sectional view of a hydrocarbon-containing formation penetrated by a horizontal well bore is illustrated. The formation 10 is penetrated by a well bore 12 containing a casing 14 surrounded by a cement sheath 16. The direction of least principal horizontal stress has been found to be as illustrated in the figure in relation to the direction in which the well bore was drilled. When a perforating gun or casing cutting gun is to be utilized to form the perforations, the number and spacing of the perforations are predetermined using information derived from the initial stress determinations. The perforating equipment is selected to provide directional control over the location of the perforations. The charges are set within the gun such that when the gun is positioned in an orientated manner within the well bore, the charges are positioned in a direction substantially perpendicular to the direction of the least principal horizontal stress of the formation. Upon detonation of the perforating gun 18, perforations or notches are formed in the casing 14, through the cement sheath 16, and into the formation 10. In some instances, the casing may be completely severed. The subsequent injection of a hydraulic fracturing fluid into the well bore results in the formation of fractures which initiate at the perforation or notch and progress perpendicularly from the direction of the least principal horizontal stress. The directionally oriented perforation provides an initiation point for application of the hydraulic pressure created by introduction of the fracturing fluid and causes the fracture to preferentially initially extend from the well bore into the desired flow path, thereby minimizing fracture reorientation and consequent restriction in the width of the fracture as it curves to the perpendicular fracture direction. Minimizing reorientation reduces the initial pressure that must be applied to achieve formation breakdown, reduces the pressure levels necessary to extend a created fracture, maximizes the fracture width achieved by the treatment and produces smoother fracture faces reducing friction effects on fluid flow.

Figure 2:
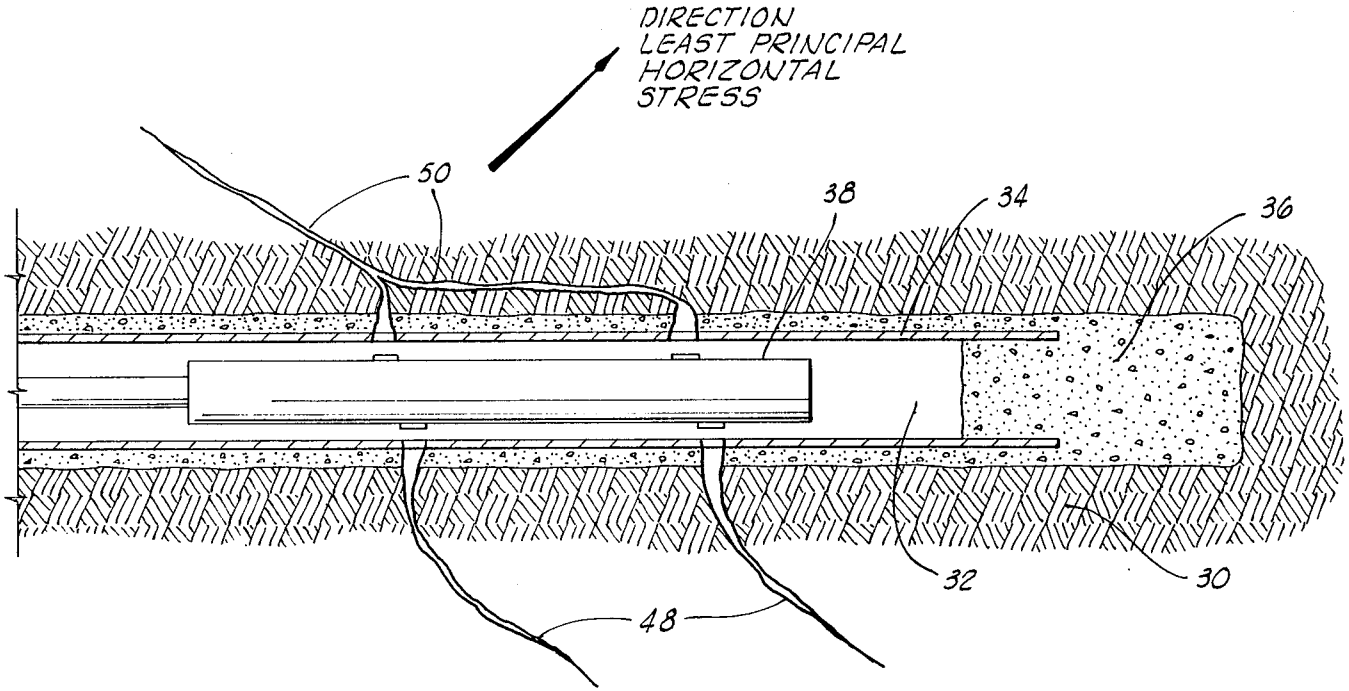
FIG. 2 is a schematic illustration of fractures formed from a horizontal well in accordance with prior art techniques.

Now referring to FIG. 2, the effects of perforations or notches in a direction other than perpendicular to the direction of the least principal horizontal stress is illustrated. The formation 30 is penetrated by a well bore 32 containing a casing 34 surrounded by a cement sheath 36. Upon detonation of the perforating gun 38 with charges oriented in a direction other than substantially perpendicular to the direction of the least principal horizontal stress, perforations creating communication to the formation are created. Application of pressure upon the formation by introduction of a hydraulic fracturing fluid results in the formation of fractures which initiate at the perforation but then rapidly reorient to a direction perpendicular to the direction of the least principal horizontal stress. The figure illustrates the reorientation processes that can occur when the perforation is not in the optimum direction. In this instance the fractures 48 curve from their initiation point to reorient in a direction perpendicular to the least principal horizontal stress. The fractures 50 start at different initiation points but because of the reorientation result in the formation of a single connected fracture. Such fracturing often results in nonplanar fractures with nonidentical wings and greater wall roughness and more angularity resulting in higher fluid friction values in comparison to fractures formed in accordance with the method of the present invention. The fractures also may form as multiple parallel fingers having only very limited fracture flow capacity. A further explanation of the effects the deviation from the direction perpendicular to the least principal horizontal stress has upon fracture orientation is set forth in SPE Paper No. 19720 entitled "Experimental Study Of Hydraulic Fracture Geometry Initiated From Horizontal Wells," the entire disclosure of which is incorporated herein by reference.

A preferred method of creating the communication between the well bore and the formation is through use of an adjustable angle hydrojetting tool wherein the desired orientation angle can be preset on the nozzle of the jetting tool and slots can be cut through the casing and the formation to form perforations or notches from which the fractures then are initiated. Hydrojetting tools are conventional devices and substantially any tool capable of indexing or adjustment to the proper nozzle angle can be utilized.

Once perforations or notches have been cut through the casing and into the formation at each desired fracture initiation point, hydraulic pressure is applied under predetermined conditions to the formation by way of such perforations or notches whereby fractures are extended from the initiation points into the formation. The application of hydraulic pressure to the formation by way of the perforations or notches involves the pumping of a selected fracturing fluid into the well bore at the surface at a rate and pressure and for a time sufficient to cause fracturing fluid to flow through the perforations or notches and extend fractures into the subterranean formation. The created fractures are extended into the formation a predetermined distance based upon the fluid utilized, the volume introduced into the wellbore, the rate and pressure and other factors. Proppant material contained in the fracturing fluid may be deposited within the created fractures to maintain the fluid flow path upon termination of the treatment or acidic agents may be present in the fluid to etch the faces of the fracture such that upon termination of the treatment a flow channel remains. The pumping then is terminated and the well bore is shut in for a time after which at least a portion of the fracturing fluid may be reverse flowed back to the surface and the completed well may be placed on production. The method of the present invention provides an added benefit of minimizing the stress or load applied to the introduced proppant by subjecting the proppant only to the loads accompanying the least principal horizontal stress.

The casing placed in the well bore may contain various tools which can be utilized to control the subsequent fracturing or production. Tools comprising valves, for example, having sliding sleeves to open or close notches in the casing may be utilized to control fracturing or production. In this instance the tool in the casing string would be cycled to an open position after which the perforations or notches would be created through the outer wall of the tool and the tool then could be closed, as desired, to isolate the formation from subsequent treatments. The tool could be actuated by pressure differential in some instances or by a sleeve positioning or setting tool conveyed on a tubing string positioned inside the casing. The sleeve positioning tool would utilize a set of fingers to engage a groove in the sliding sleeve to position the sleeve which would disengage upon completion of the movement of the sleeve. A more complete description of such tools is set forth in U.S. Pat. No. 4,880,059 the entire disclosure of which is incorporated herein by reference.

In one embodiment, prior to applying hydraulic pressure to a significant number of the perforations or notches, the perforations are individually isolated by packer devices and hydraulic pressure is applied to each perforation or set of perforations by pumping a controlled volume of fluid through the perforation at the predetermined conditions described above. This preliminary application of hydraulic pressure insures that the perforations are open and to create a small initial fracture into the formation at each fracture initiation point. Also, the information relating to the fractures thus formed can be used to check fluid and formation variables to thereby insure that the final application of hydraulic pressure to the formation through a greater number of perforations creates the desired fractures into the formation. In some instances, the final application of hydraulic pressure may be to all of the perforations or notches to substantially simultaneously extend the fractures. In other instances where this may not be possible due to limited pumping capacity or the like, hydraulic pressure can be applied to groups of the perforations or notches successively.

The fracturing fluid utilized to create the fractures in the method of the present invention can comprise substantially any aqueous or nonaqueous fluid that does not adversely react with the subterranean formation to prevent hydrocarbon production. The fracturing fluid may contain gelling agents, crosslinking agents, gel breakers, pH control additives, corrosion inhibitors, fluid loss additives, retarders, surfactants, carbon dioxide, nitrogen and the like. Preferably, at least a portion of the fracturing fluid introduced into the well bore contains a proppant material that is deposited in the created fracture to prop the fracture in an open position upon completion of the fracturing treatment. The proppant can comprise any of the conventional propping agents such as sand, resin coated sand, sintered bauxite, ceramics and the like which are suitable for the pressure conditions to be experienced in the subterranean formation.

In order to further illustrate the present invention, and facilitate a clear understanding thereof, the following example is provided.

EXAMPLE

The method of the present invention whereby directionally orientated perforations or notches are formed through casing set in a horizontal well whereby fractures having improved flow capacity can be formed is to be carried out in the Bartlesville formation at a depth of approximately 6000 feet.

The direction of the least principal horizontal stress has been determined from previously drilled wells in the formation to be 135° E of N. The well is staked in the northern portion of the lease and is to be drilled to the SE. Because of an existing well located in the same direction that had exhibited longtime production, it was decided to drill the well 155° E of N from the vertical well through a medium radius bend. To intersect the formation in a direction perpendicular to the in situ least principal horizontal stress the perforations would have to be at an angle of 20° from the normal horizontal axis of the perforating device. A series of perforations are created with a jet perforating gun at 20° from the horizontal axis of the gun. A fracturing fluid then is introduced into the well bore at a rate and pressure sufficient to extend fractures into the formation from the created fracture initiation points. The fractures are found to extend with a minimum application of pressure and without near well bore choking.

Thus the present invention is well adapted to attain the ends and advantages previously mentioned as well as those inherent therein. While numerous changes can be made in the steps, their sequence, testing techniques employed and the like, such changes are encompassed within the spirit of this invention as defined by the appended claims.

What is claimed is:

1. A method of forming fractures in a subterranean formation from a deviated well bore penetrating the formation comprising:

drilling a deviated well bore into said subterranean formation in a direction other than parallel to the direction of the least principal horizontal stress;

determining the in situ least principal horizontal stress direction in said formation;

creating a plurality of directionally orientated fracture initiation points in said well bore, said initiation points being formed in a direction perpendicular to the direction of the in situ least principal horizontal stress; and applying hydraulic pressure to said fracture initiation points in an amount sufficient to fracture said subterranean formation, said fracture being created in substantially the same direction as the direction of the fracture initiation points.

2. The method of claim 1 wherein said step of determining the in situ least principal horizontal stress direction is effected by forming a fracture in said formation by application of hydraulic pressure through said well bore upon said formation and removing a location orientated core containing a portion of said fracture from said well bore.

3. The method of claim 1 wherein the application of hydraulic pressure to said formation comprises pumping a fracturing fluid into said formation at a rate and pressure sufficient to fracture the formation.

4. The method of claim 1 wherein the orientated fracture initiation points are formed by directionally orientated shaped charges positioned within said well bore.

5. The method of claim 1 wherein the orientated fracture initiation points are formed by a directionally controllable nozzle on a hydrojetting tool.

6. A method of reducing fracture frictional pressure losses in a deviated well penetrating a subterranean formation in a direction other than a parallel to the direction of the in situ least principal horizontal stress comprising:

drilling a deviated well bore into a subterranean formation in a direction other than parallel to the direction of the in situ least principal horizontal stress;

determining the direction of the in situ least principal horizontal stress in said formation;

casing the well bore;

creating a plurality of directionally orientated fracture initiation points in said casing and formation, said initiation points extending through said casing and into said formation in a direction substantially perpendicular to the direction of said in situ least principal horizontal stress;

applying hydraulic pressure to said fracture initiation points in an amount sufficient to fracture the formation whereby fracturing is effected in the tensile mode and frictional pressure loses resulting from passage of a fluid past the wall of the fracture face near the well bore is minimized.

7. The method of claim 6 wherein said step of determining the in situ least principal horizontal stress direction is effected by at least one of the following methods comprising:

(i) forming a fracture in said formation by application of hydraulic pressure through said well bore upon said formation and removing a location orientated core containing a portion of said fracture from said well bore, (ii) strain gauge relaxation measurements on a location orientated core, (iii) bore hole televiewer and (iv) direction orientated fracture impression packer.

8. The method of claim 6 wherein the application of hydraulic pressure to said formation comprises pumping a fracturing fluid into said formation at a rate and pressure sufficient to fracture the formation.

9. The method of claim 6 wherein the orientated fracture initiation points are formed by directionally orientated shaped charges positioned within said casing.

10. The method of claim 6 wherein the orientated fracture initiation points are formed by a directionally controllable nozzle on a hydrojetting tool.

11. The method of claim 6 wherein the hydraulic pressure is created with a fracturing fluid including a particulate proppant material.

12. The method of claim 6 wherein said subterranean formation contains hydrocarbons.

13. A method of forming fractures in a subterranean hydrocarbon-containing formation from a deviated well bore penetrating the formation comprising:

drilling a deviated well bore into said subterranean formation in a direction other than parallel to the direction of the in situ least principal horizontal stress;

determining the direction of the in situ least principal horizontal stress in said formation;

casing the well bore;

cementing at least a portion of said casing within said well bore;

creating a plurality of directionally orientated fracture initiation points in said casing and formation, said initiation points extending through said casing and into said formation in a direction substantially perpendicular to the direction of the in situ least principal horizontal stress;

applying hydraulic pressure to at least a portion of said fracture initiation points in an amount sufficient to create at least one fracture in said formation in substantially the same direction as the direction of said fracture initiation points.

14. The method of claim 13 wherein said step of determining the in situ least principal horizontal stress direction is effected by at least one of the following methods comprising:

(i) forming a fracture in said formation by application of hydraulic pressure through said well bore upon said formation and removing a location orientated core contacting a portion of said fracture from said well bore.

(ii) strain gauge relaxation measurements on a location oriented core, (iii) bore hole televiewer and (iv) direction oriented fracture impression packer.

15. The method of claim 13 wherein the application of hydraulic pressure to said formation comprises pumping a fracturing fluid into said formation at a rate and pressure sufficient to fracture the formation.

16. The method of claim 13 wherein the oriented fracture initiation points are formed by directionally orientated shaped charges held by a perforating gun.

17. The method of claim 13 wherein the orientated fracture initiation points are formed by a directionally controllable nozzle on a hydrojetting tool.

18. The method of claim 13 wherein the application of hydraulic pressure to said formation comprises pumping a fracturing fluid containing a suspended proppant material through said well bore to contact said fracture initiation point and pass therethrough at a rate and pressure sufficient to fracture said formation at said initiation point, extend such fracture into said formation and deposit said proppant in said created fracture.

19. The method of claim 13 wherein the application of hydraulic pressure to said formation comprises pumping an acidic aqueous fracturing fluid into said formation at a rate and pressure sufficient to fracture said formation, extend such fractures therein and etch flow channels in the fracture faces.

* * * * *